US011008200B2

(12) United States Patent
Fox

(10) Patent No.: US 11,008,200 B2
(45) Date of Patent: May 18, 2021

(54) FLOOR JACK CHASSIS

(71) Applicant: VIS, LLC, Greenville, SC (US)

(72) Inventor: Robert Fox, Greenville, SC (US)

(73) Assignee: VIS, LLC, Travelers Rest, SC (US)

( * ) Notice: Subject to any disclaimer, the term of this patent is extended or adjusted under 35 U.S.C. 154(b) by 252 days.

(21) Appl. No.: 16/183,102

(22) Filed: Nov. 7, 2018

(65) Prior Publication Data

US 2020/0140246 A1 May 7, 2020

(51) Int. Cl.
*B66F 5/04* (2006.01)

(52) U.S. Cl.
CPC ..... *B66F 5/04* (2013.01); *B66F 2700/052* (2013.01)

(58) Field of Classification Search
CPC ..... B66F 2700/123; B66F 5/00; B66F 5/02; B66F 5/025; B66F 5/04
See application file for complete search history.

(56) References Cited

U.S. PATENT DOCUMENTS

| | | | | |
|---|---|---|---|---|
| D284,417 | S | 6/1986 | Yamagishi | |
| D296,598 | S | 7/1988 | Hung | |
| D332,337 | S | 1/1993 | Wang | |
| D388,926 | S | 1/1998 | Sorensen | |
| D421,516 | S | 3/2000 | Hung | |
| 6,264,169 | B1 * | 7/2001 | Hung | B66F 5/04 254/1 |
| D452,597 | S | 12/2001 | Hung | |
| D453,983 | S | 2/2002 | Lin | |
| D480,196 | S | 9/2003 | Hsu | |
| D483,169 | S | 12/2003 | Fox | |
| D531,377 | S | 10/2006 | Liu | |
| D582,823 | S | 12/2008 | Longpre et al. | |
| D590,121 | S | 4/2009 | Shen | |
| D604,025 | S | 11/2009 | Lin | |
| D628,760 | S | 12/2010 | Fox et al. | |
| D688,845 | S | 8/2013 | Hernandez et al. | |
| 8,500,095 | B1 | 8/2013 | Salcedo | |
| 8,608,131 | B2 | 12/2013 | Kania | |
| 8,622,369 | B2 | 1/2014 | Kania | |
| D720,514 | S | 12/2014 | Fox et al. | |
| 8,919,734 | B2 * | 12/2014 | Fu | B66F 5/04 254/2 B |
| D720,914 | S | 1/2015 | Fox | |
| D720,915 | S | 1/2015 | Fox | |
| D730,612 | S | 5/2015 | James et al. | |
| D799,142 | S * | 10/2017 | Fox | D34/31 |
| D835,378 | S * | 12/2018 | Huang | D34/31 |
| 2006/0278858 | A1 | 12/2006 | Brocchini, Jr. | |
| 2008/0083913 | A1 | 4/2008 | Fang et al. | |

* cited by examiner

*Primary Examiner* — Tyrone V Hall, Jr.
(74) *Attorney, Agent, or Firm* — J. Bennett Mullinax, LLC

(57) ABSTRACT

A chassis member for a hydraulic floor jack having angled side frame members which have a curved upper surface and provide an inner wall attached to a rear side frame and an outer wall attached to a tapered surface of a caster support bracket.

9 Claims, 6 Drawing Sheets

FLOOR JACK CHASSIS

FIELD OF THE INVENTION

This invention is directed towards a chassis for a portable floor jack.

BACKGROUND OF THE INVENTION

This invention relates to hydraulic floor jacks, particularly portable hydraulic floor jacks used in automotive repair centers and garages. Over the years, the design of hydraulic floor jacks has changed as the clearance height of certain vehicles has been modified and the weight of popular vehicles has increased. In response to changes in the industry, portable floor jacks have adopted a lower profile to accommodate more vehicles. At the same time, there has been an emphasis on cost savings that, might be achieved through weight reduction. At times a manufacturer may use thinner or less costly materials or use materials having lower strength characteristics. As a result, many floor jack designs have a chassis which are prone to warp or flex under higher weight, loads. Accordingly, there is a need for improvement in the art of providing a chassis for a portable floor jack that offers improved durability and strength characteristics.

SUMMARY OF THE INVENTION

It is at least one aspect of at least one of the present embodiments to provide for a chassis for a hydraulic floor jack comprising: a front chassis member; a first and a second rear side member; a first side member connected at a first end to the front chassis member; a second side member connected at a first end to the front chassis member; the first side member and the second side member each being unitary and having a curved upper edge wall, an exterior wall, and an interior wall, the exterior wall and the interior wall having a spaced distance between a lower most portion of the respective edge walls which is greater than a spaced distance along an upper portion of the opposing edge walls, the upper edge walls and the inner surface of the curved upper edge wall defining a open cavity.

It is at least one aspect of at least one embodiment of the present invention to provide for a chassis of a floor jack as described above wherein a length of the curved upper edge of the side member is greater than a length of the lower most portion of the exterior edge wall and the lower most portion of the inner edge wall.

It is at least one aspect of at least one embodiment of the present invention to provide for a chassis of a floor jack as discussed above wherein the first side member and the second side member each define a corresponding second end, an upper edge of each side member second end is attached to a caster mounting bracket.

It is at least one aspect of at least one embodiment of the present invention to provide for a chassis of a floor jack as provided above wherein a portion of the exterior side wall member is attached to the caster mounting bracket.

It is at least one aspect of at least one embodiment of the present invention to provide for a chassis of a floor jack as provided above wherein the caster mounting bracket further defines a horizontal portion for receiving there through a caster support bolt and further defining a non-horizontal portion which has an inner edge bracket wall which is attached to an exterior surface a rear side member.

It is at least one aspect of at least one embodiment of the present invention to provide for a chassis of a floor jack as provided above wherein an inner edge wall of the caster mounting bracket is secured to a rear side member.

It is at least one aspect of at least one embodiment of the present invention to provide for a chassis of a floor jack comprising a chassis as described above 1 wherein the included angle defined between the exterior wall and the interior wall of the respective side members is between about 25 to about 45 degrees.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5. The term "about" means plus or minus 10% of the stated value or range.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
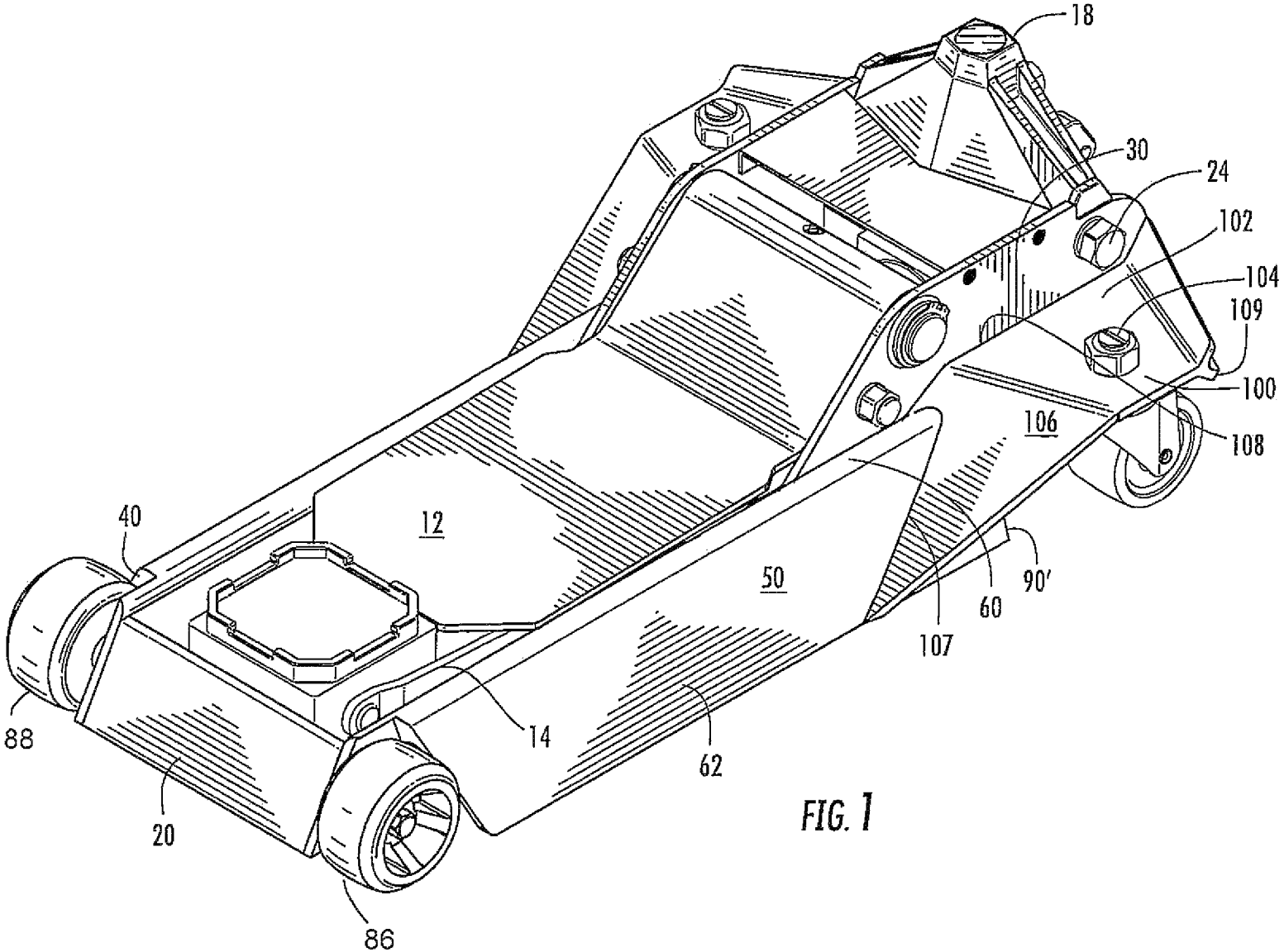
FIG. 1 is a front perspective view of the floor jack according to the present design.
Figure 2:
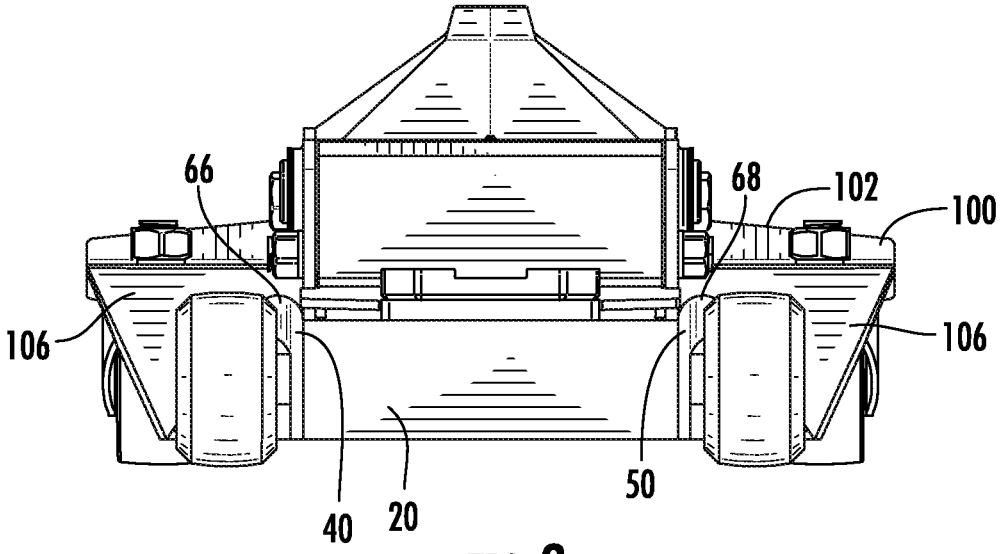
FIG. 2 is a front view of the floor jack as shown in FIG. 1.
Figure 3:
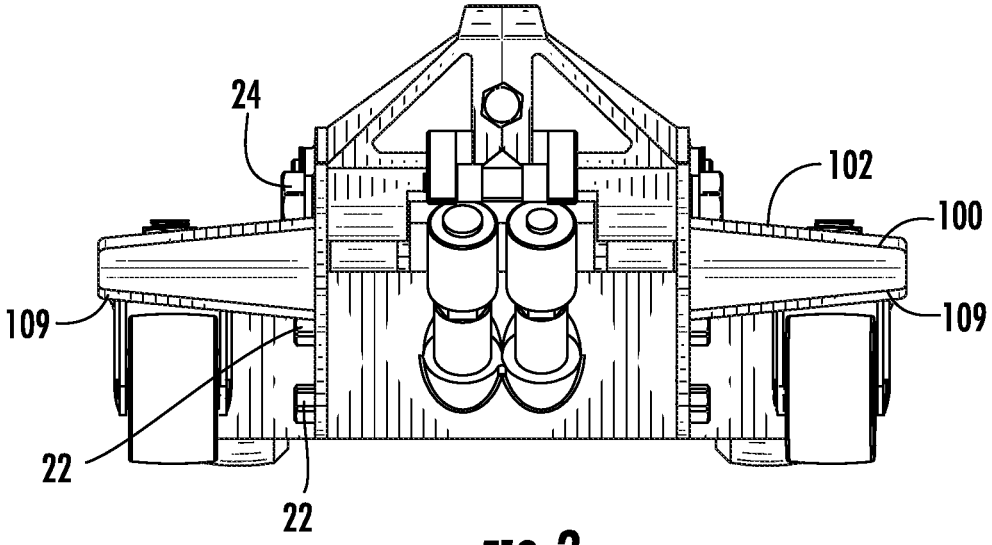
FIG. 3 is a rear view of the floor jack as shown in FIG. 1.
Figure 4:
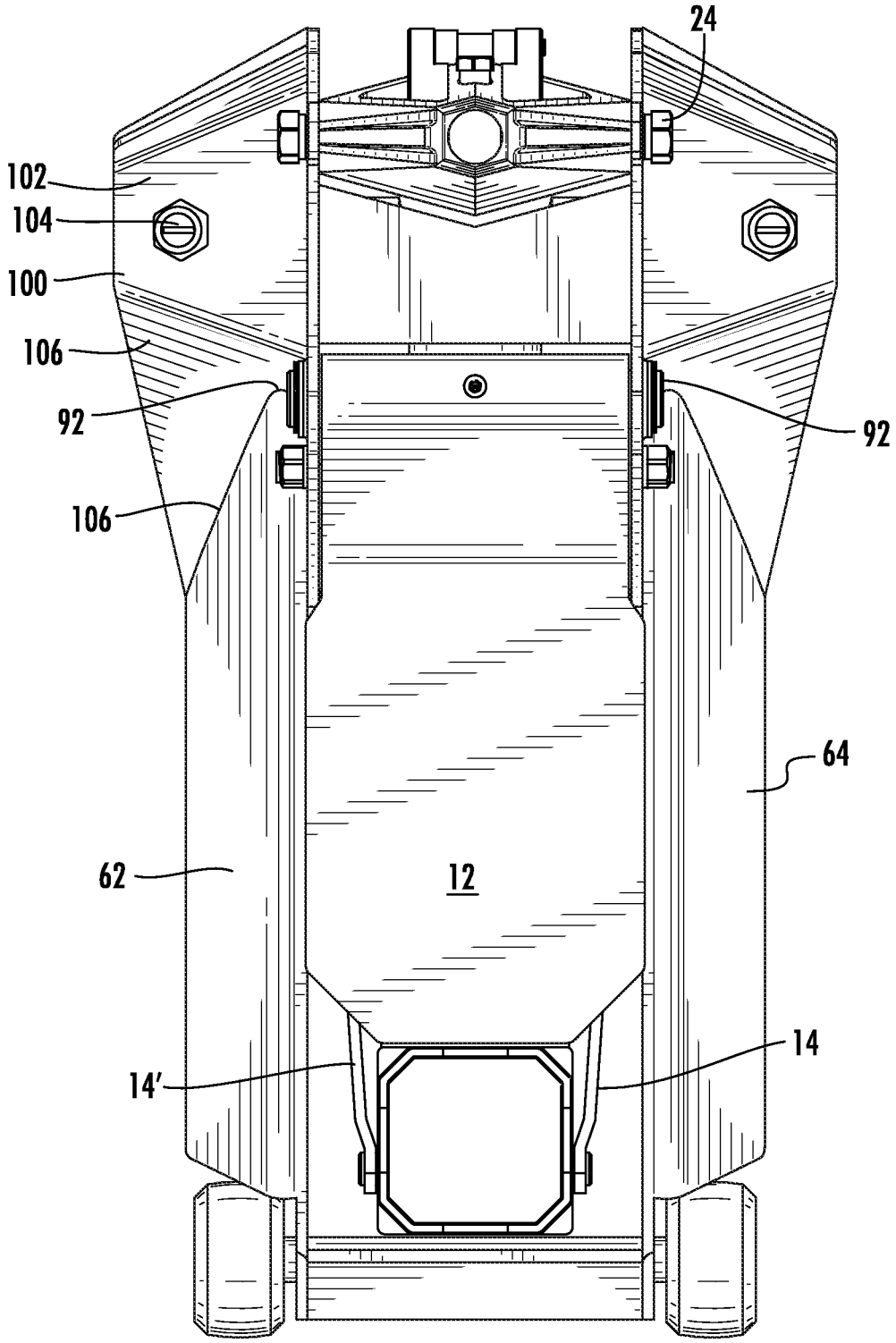
FIG. 4 is a top view of the floor jack as shown in FIG. 1.
Figure 5:
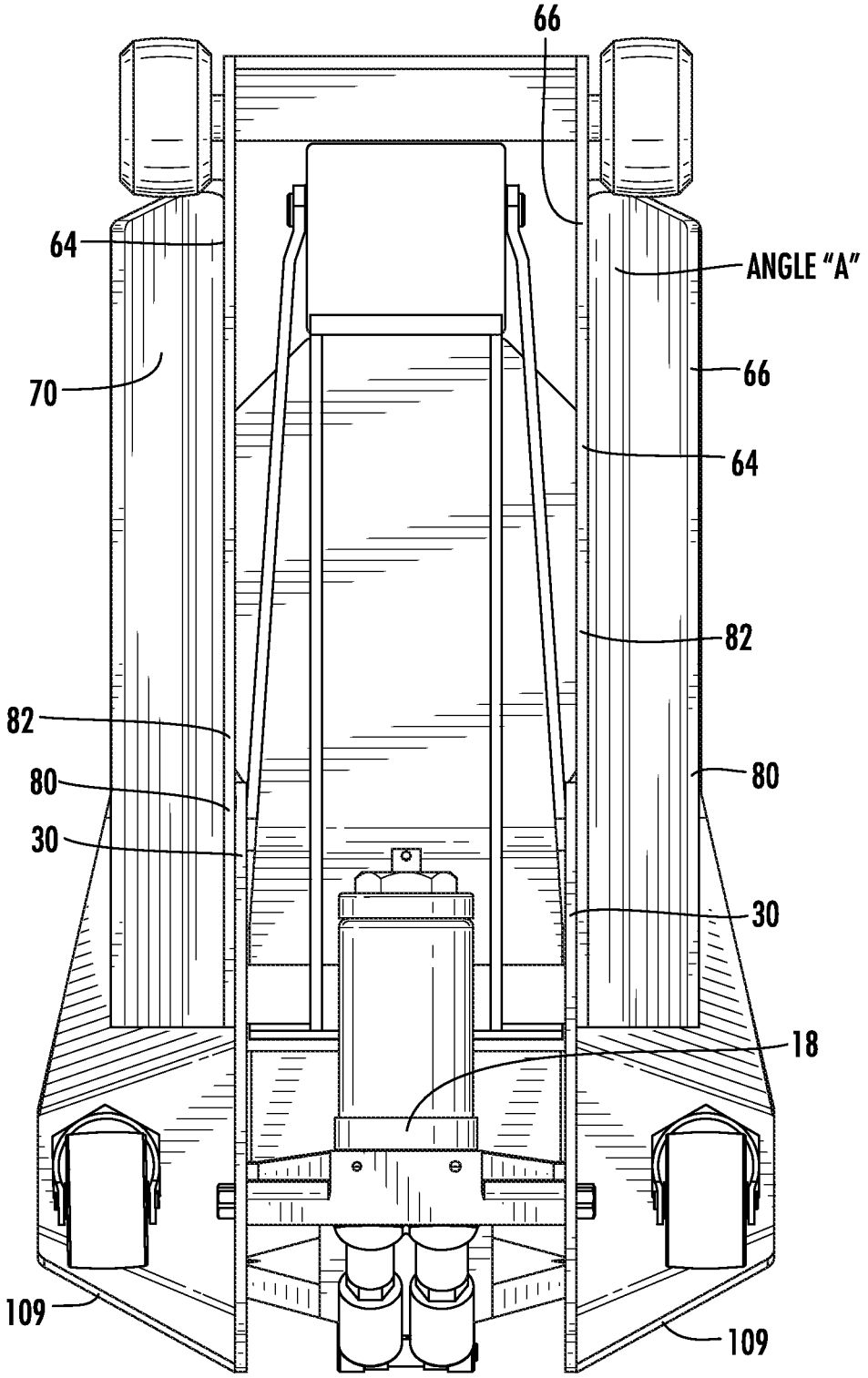
FIG. 5 is a bottom view of the floor jack as shown in FIG. 1.
Figure 6:
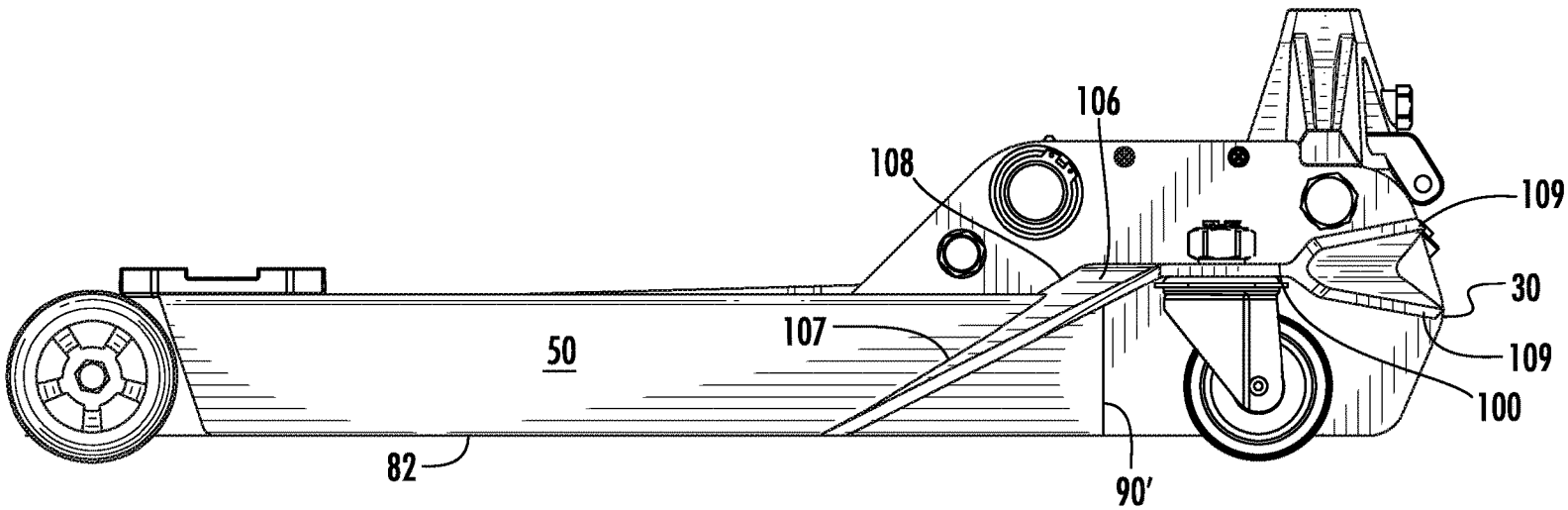
FIG. 6 is a right-side view of the floor jack as shown in FIG. 1.
Figure 7:
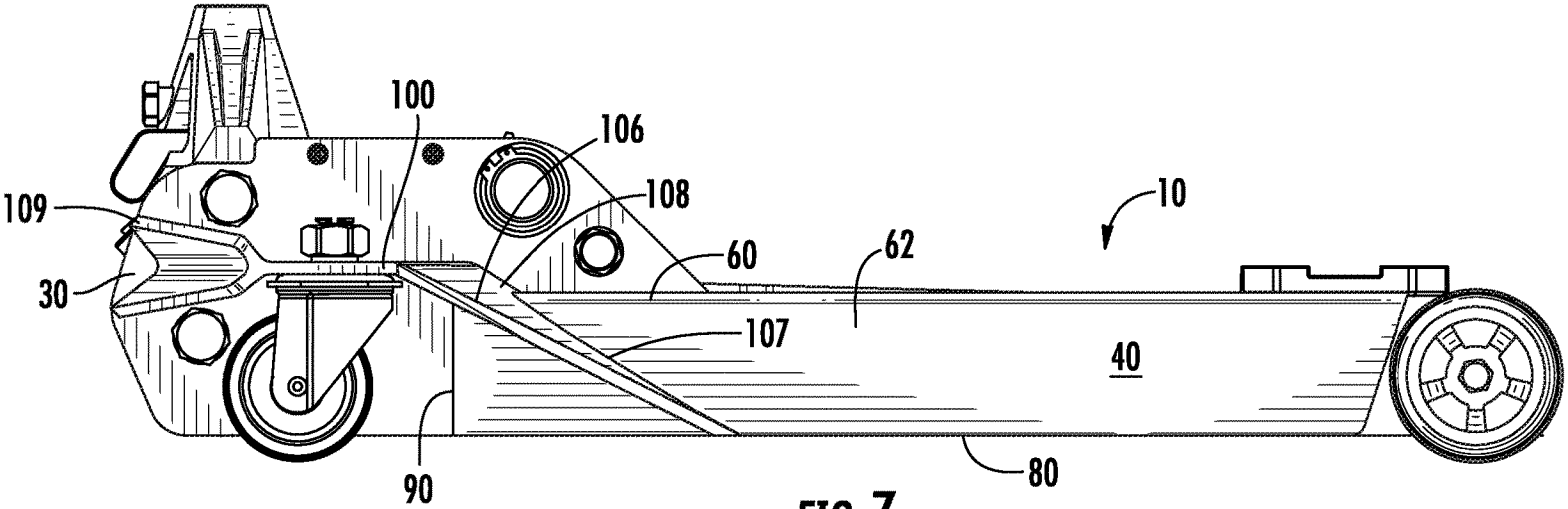
FIG. 7 is a left side view of the floor jack as shown in FIG. 1.

As seen in reference to FIGS. 1-7, a chassis 10 for a hydraulic floor jack is provided having a front chassis member 20; a pair of spaced adjacent rear side members 30 and 30'; a first side member 40 connected at a first end to the front chassis member; a second side member 50 connected at first end to the front chassis member. A first end 66 and 68 of the interior walls 64 defines an angled projection which extends to the front chassis member 20.

The first side member and the second side member each are unitary and have a curved upper edge wall 60, an exterior wall 62, and an interior wall 64, the exterior wall 62 and the interior wall 64 having a spaced distance between a lower most portion 66 of the respective edge walls which is greater than a spaced distance along an upper portion of the opposing edge walls, the upper edge walls and the inner surface of the curved upper edge wall defining an open cavity 70.

The rear side members 30 and 30' of the chassis are parallel to one another and provide a space in between them to accommodate the jack's lift arm 12, guide arms 14 and 14', power unit and handle yoke 18. The power unit mounting bolts 22 (FIG. 3) and handle yoke pivot bolts 24 holes are positioned in the rear side members 30 and 30'. The handle yoke pivot bolt mounting holes are positioned farther to the rear of the rear side members 30 and 30' and therefore requiring a cross bolt connected to both ends of the rear side members in order to prevent an outward flex of the rear side members. An outward flex could cause other hardware involving the rear side members to come loose. Alternative ways to re-enforce the strength of the rear side members to prevent them from flexing may be accomplished by designing the caster mounting brackets to extend farther to the rear of the rear side members. The flute design 109 on the rear of the caster mounting brackets extends the length of the caster mounting brackets and the corresponding attachment area to the rear of the rear side members 30 and 30' thus providing added strength to overcome flexing and eliminate the need for a cross bolt.

Side members 40 and 50 maintain the low profile of the saddle all the way back to the front edge of the rear side members 30 and 30'. This low profile enables the jack to fit further under low ground clearance vehicles. Reducing the profile of the side members makes them vulnerable to twisting and deforming under certain vehicle lift conditions. Another portion of the side members that are vulnerable to deformation is right where the side arms are attached to the front edges of the rear side members 30 and 30'. The first and second side members 40 and 50 are formed in such a way as to re-enforce the low-profile design.

The chassis 10 further provides a length of curved upper edge wall 60 which is greater than a length of the lower most portion 80 and 82 of the side members 40 and 50. A distance between the lower most portions of the respective edge walls is greater than a length defined between an outer edge surface of a pair of front wheels 86 and 88.

The chassis 10 first side member 40 and the second side member 50 each define a corresponding second end 90 and 90', an upper edge 92 of each side member second end being attached to caster mounting bracket 100. A portion of the exterior side wall 62 is attached to the caster mounting bracket 100.

The caster mounting bracket 100 further defines a substantially horizontal portion 102 for receiving there through a caster support bolt 104 and further defining a non-horizontal portion 106 which has an inner edge bracket wall 108 and which is attached to an exterior surface of the respective rear side member 30/30' and the exterior walls 62 of side members 40 and 50.

A rear end wall 109 of the caster mounting bracket 100 is secured to the rear side member 30 along an interior edge of rear end wall 109, rear end wall 109 seen in the form of a "Y" shaped flute structure. As seen in reference to FIG. 1, a second end of the respective side members 40 and 50 are attached to the non-horizontal portion 106 of bracket 100 at an angle along an edge portion 107 of respective side members 40 and 50.

The included angle "A" defined, between the exterior wall 62 and the interior wall 64 of the respective side members, is between about 25 to about 45 degrees.

The chassis described herein provides for a structure that provides reinforcement to the areas of a chassis which may deform underload. Accordingly, the unique shape of the side members 40 and 50, the attachment via portions 66 and 68 of the respective side frame members to the front chassis 20, the positioning attachment of the side frame members 40 and 50 to the caster bracket 100 along with the shape and positioning of the caster bracket 100 to the rear side members plates 30 and 30' result in a chassis frame that resists structural deformation during heavy lifting operations.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the claims of present invention. In addition, aspects of the various embodiments may be interchanged, both in whole, or in part. Therefore, the spirit and scope of the invention should not be limited to the description of the preferred versions contained therein.

That which is claimed:

1. A chassis for a hydraulic floor jack comprising:

a front chassis member;

a pair of rear side members;

a first side member connected at a first end to the front chassis member;

a second side member connected at a first end to the front chassis member;

the first side member and the second side member each being unitary and having a curved upper edge wall, an exterior wall, and an interior wall, the exterior wall and the interior wall having a spaced distance between a lower most portion of the respective edge walls which is greater than a spaced distance along an upper portion of the opposing edge walls, the upper edge walls and the inner surface of the curved upper edge wall defining a open cavity.

2. The chassis according to claim 1 wherein a length of the curved upper edge is greater than a length of the lower most portion of the exterior edge wall and the lower most portion of the inner edge wall.

3. The chassis according to claim 1 wherein the first side member and the second side member each define a corresponding second end, an upper edge of each side member second end is attached to caster mounting bracket.

4. The chassis according to claim 3 wherein a portion of the exterior side wall member is attached to the caster mounting bracket.

5. The chassis according to claim 4 wherein the caster mounting bracket further defines a horizontal portion for receiving there through a caster support bolt and further defining a non-horizontal portion which has an inner edge bracket wall which is attached to an exterior surface of the respective rear side member exterior wall.

6. The chassis according to claim 1 wherein an included angle defined between the exterior wall and the interior wall of the respective side members is between about 25 to about 45 degrees.

7. The chassis according to claim 1 wherein a distance between the lower most portions of the respective edge walls is greater than a length defined between an outer edge surface of a pair of front wheels.

8. A chassis for a hydraulic floor jack comprising:

a front chassis member;

a pair of rear side members;

a first side member connected at a first end to the front chassis member;

a second side member connected at a first end to the front chassis member;

the first side member and the second side member each being unitary and having a curved upper edge wall, an exterior wall, and an interior wall, the exterior wall and the interior wall having a spaced distance between a lower most portion of the respective edge walls which is greater than a spaced distance along an upper portion of the opposing edge walls, the upper edge walls and the inner surface of the curved upper edge wall defining a open cavity;

wherein a length of the curved upper edge is greater than a length of the lower most portion of the exterior edge wall and the lower most portion of the inner edge wall;

wherein the first side member and the second side member are each unitary and each define a corresponding second end, an upper edge of each side member second end is attached to caster mounting bracket; and wherein an included angle defined between the exterior wall and the interior wall of the respective side members is between about 25 to about 45 degrees.

9. The chassis according to claim 8 wherein a distance between the lower most portions of the respective edge walls is greater than a length defined between an outer edge surface of a pair of front wheels.

* * * * *